United States Patent [19]

Stahl et al.

[11] Patent Number: 4,557,416

[45] Date of Patent: Dec. 10, 1985

[54] MULTIPLE-UNIT MAIL BOX

[75] Inventors: Benedict J. Stahl, 12282 Woodbine, Detroit, Mich. 48239; Thomas L. Hierman, Pickney, Mich.

[73] Assignee: Benedict J. Stahl, Detroit, Mich.

[21] Appl. No.: 660,633

[22] Filed: Oct. 15, 1984

[51] Int. Cl.[4] ..... B65D 91/00

[52] U.S. Cl. ..... 232/24; 232/43.4; 109/56

[58] Field of Search ..... 232/24, 25, 27, 43.1, 232/43.4; 109/53, 56; 312/211

[56] References Cited

U.S. PATENT DOCUMENTS

| | | | |
|---|---|---|---|
| 950,935 | 3/1910 | Lorenz et al. | 109/56 |
| 1,060,018 | 4/1913 | Pape | 109/56 |
| 2,781,965 | 2/1957 | Dembs | 232/43.4 |
| 4,121,758 | 10/1978 | Bonner | 232/24 X |
| 4,446,797 | 5/1984 | French | 109/53 |

*Primary Examiner*—Robert P. Swiatek
*Attorney, Agent, or Firm*—Brooks & Kushman

[57] ABSTRACT

A multiple-unit mailbox apparatus comprising a number of parallel hinge door assemblies, a plurality of tubular mail receptacles and an outer support structure including a front panel which supports the receptacles and the hinge door assemblies at its front surface. The outer support structure also includes interconnected top, bottom and side panels including a back panel. The front panel has a plurality of container openings in which the mail receptacles are supported in spaced relationship from each other so that the receptacles can receive mail inserted therethrough. Each hinge door assembly includes a hinge rod fixedly mounted at its opposite ends to top and bottom weather strip portions of the front panel. Each hinge rod extends through intermediate strip portions of the front panel which are positioned between adjacent container openings. Each hinge door assembly also includes a set of aligned receptacle doors which are individually hinged on its respective hinge rod at spaced locations corresponding to receptacle openings formed at the front ends of the receptacles.

11 Claims, 7 Drawing Figures

MULTIPLE-UNIT MAIL BOX

TECHNICAL FIELD

This invention relates to multiple-unit mail boxes and, in particular, to multiple-unit mail boxes manufactured from a relatively small number of parts which are relatively simple and inexpensive to make and assemble.

BACKGROUND ART

Multiple-unit mail boxes, also known as neighborhood delivery and collection box units or cluster boxes, are often installed in new housing developments. The U.S. Postal Service typically prefers cluster boxes because they allow mail for a number of homes to be delivered to a central point, saving time, fuel and money.

Recently, the U.S. Postal Service has become the dominant buyer of such multiple-unit mail boxes. One result of this is that prices of such multiple-unit box units have been drastically reduced. The manufacturing cost of such conventional multiple-unit mail boxes has left little room for profit. Consequently, there is a need to produce a cost-effective multiple-unit mail box, while at the same time retaining and even enhancing such desirable qualities as: high-strength, cosmetically appealing, security and resistant to various weather conditions.

Prior art patents disclose various construction of multiple-unit mail boxes. For example, U.S. Pat. No. 1,817,191 to Harmony discloses a mail box station having individual boxes interchangeably fitted in the compartments of the mail box station.

U.S. Pat. No. 3,081,023 to Taylor discloses an assembly of rural mail boxes which are adapted for connection with similar mail boxes so that a group of the mail boxes may be established at one particular location. Each mail box is formed from one continuous piece of metal such as aluminum as some other light and noncorrosive metal.

U.S. Pat. No. 4,121,758 to Bonner discloses a gang-type mail box having a number of compartments each having a liner with a metal slide. Other patents of lesser relevance to the present invention include U.S. Pat. Nos. 1,612,335; 1,709,363; 1,719,541; 1,735,379; 1,747,003; 4,148,432 and 4,247,039.

DISCLOSURE OF THE INVENTION

An object of the present invention is to provide an improved multiple-unit mail box which has a relatively small number of parts and which is simple and inexpensive to make and assemble.

Another object of the present invention is to provide an improved multiple-unit mail box which is not only cost-efficient but also provides adequate security, is cosmetically appealing, has high strength and stands up well during inclement weather conditions.

In carrying out the above objects and other objects of the present invention, a multiple-unit mail box apparatus constructed in accordance with the present invention includes an outer support structure having interconnected top, bottom and side panels including front and back panels. The front panel has a plurality of container openings including an aligned set of container openings. The apparatus also includes a like plurality of tubular receptacles which are supported by and within the support structure in spaced relationship from each other between the front and back panels adjacent the container openings. The receptacles receive and retain mail inserted through receptacle openings of the receptacles at the front end thereof. A hinge door assembly is provided for selectively opening and closing the receptacle openings. The assembly includes a hinge rod fixedly mounted at its opposite ends to the front panel and a set of aligned receptacle doors which are individually hingedly mounted on the hinge rod at spaced locations corresponding to an aligned set of said receptacle openings.

Preferably the multiple-unit mail box apparatus comprises a matrix of at least two sets of aligned tubular receptacles and further comprises a second hinge door assembly including a second hinge rod which is fixedly mounted at its opposite ends to the front panel parallel to the first hinge rod for rotatably mounting a second set of aligned receptacle doors adjacent their respective aligned receptacle openings.

Also, preferably, the front panel includes a plurality of spaced parallel weather strip portions formed immediately adjacent their respective container openings. Each hinge rod is fixedly mounted at its opposite ends to the outermost strip portions and extends through at least one strip portion intermediate the outermost strip portions.

The receptacles preferably include front and rear attachment flanges attached to the outer surface of the front panel about the outer periphery of their respective container openings and the inner surface of the back panel, respectively.

This construction allows for a relatively small number of parts which are simple and inexpensive to make and assemble. In particular, the front panel of the support structure is formed from a single piece of sheet material so as to support the tubular receptacles at its front surface and provide weather strip portions about its outer periphery and between the container openings. Some of the weather strip portions also provide attachment locations for the hinge rods of the door assemblies. The number of receptacles that can be accommodated is only limited by the dimensions of the sheet material.

The multiple-unit mail box apparatus of the present invention is cosmetically appealing, has high strength and security and is able to withstand a variety of inclement weather conditions.

The objects, features and advantages of the present invention are readily apparent from the following detailed description of the best mode when taken in connection with the accompanying drawings.

BEST MODE FOR CARRYING OUT THE INVENTION

Figure 1:
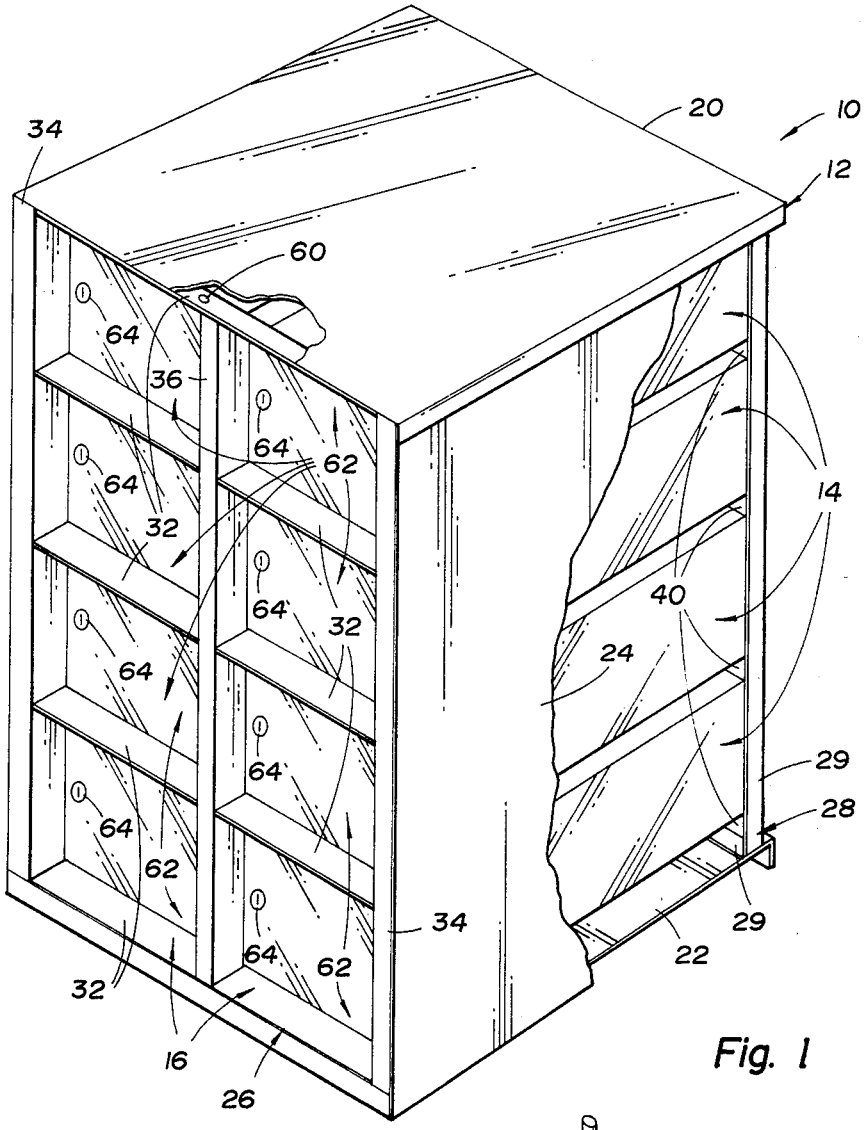
FIG. 1 is a perspective view of a multiple-unit mail box apparatus constructed in accordance with the present invention.
Figure 2:
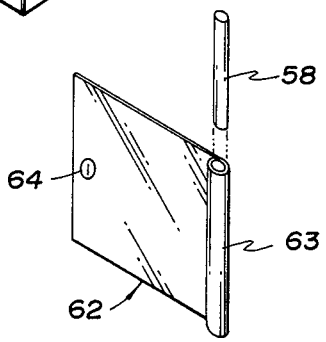
FIG. 2 is a perspective view of a door and a hinge rod of a hinge door assembly of the present invention.
Figure 3:
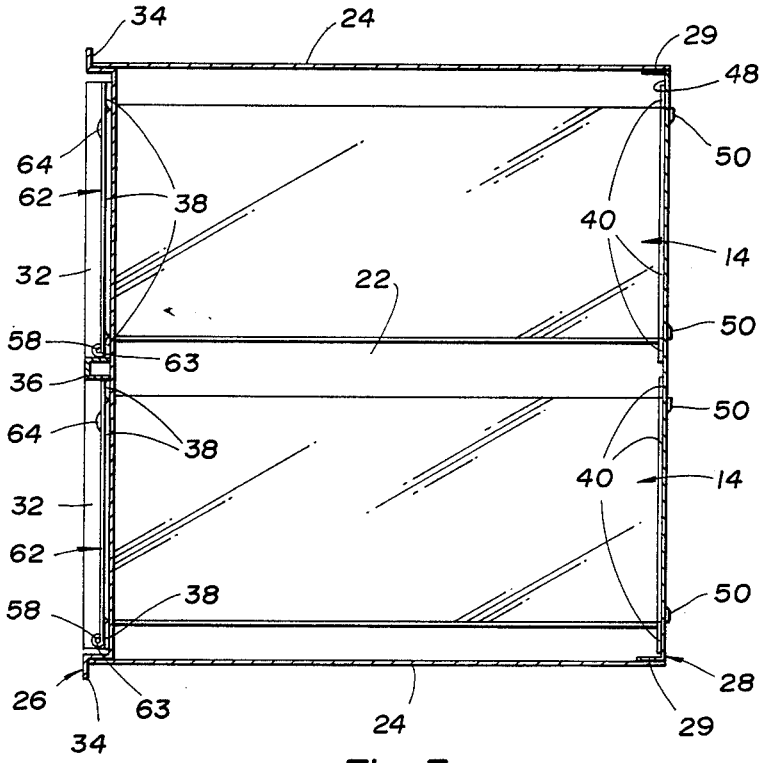
FIG. 3 is a top sectional view of the mail box apparatus.
Figure 4:
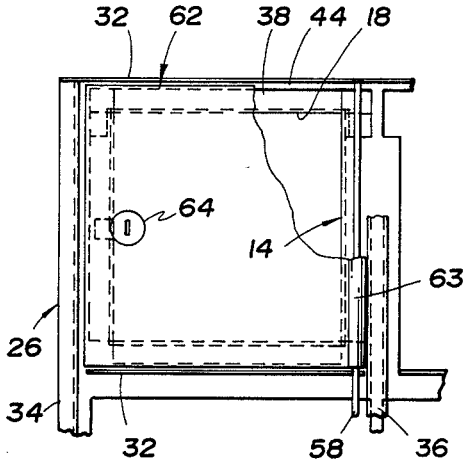
FIG. 4 is a front view, partially broken away, of the mail box apparatus.
Figure 5:
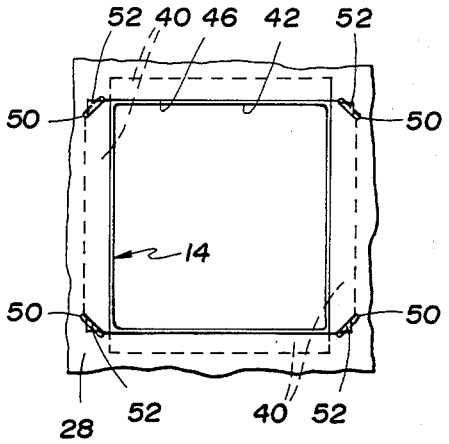
FIG. 5 is a rear view, partially broken away, of the mail box apparatus.

Referring now to the drawings, there is illustrated in FIGS. 1 through 5, a multiple-unit mail box apparatus, generally indicated at 10, constructed in accordance with the present invention. The apparatus 10 includes an outer support structure, generally indicated at 12, and a plurality of tubular receptacles, each of which is generally indicated at 14. The receptacles are supported by the support structure 12 therewithin in spaced relationship from each other. The apparatus 10 also preferably includes a pair of substantially identical hinge door assemblies, each of which is generally indicated at 16. The hinge door assemblies 16 are provided for selectively opening and closing receptacle openings 18 at the front ends of the receptacles 14. It is to be understood that a mail box apparatus constructed in accordance with the present invention may include a single hinge door assembly or more than two hinge door assemblies as desired.

The outer support structure 12 includes a top panel 20, a bottom panel 22, side panels 24, a front panel generally indicated at 26 and a back panel generally indicated at 28, all of which are interconnected and secured to each other, preferably by rivets. The back panel 28 includes four attachment flanges 29 to facilitate attachment of the back panel 28 to the other panels 20, 22 and 24 by rivets. Also, preferably, each of the panels 20 through 28 are made from continuous pieces of sheet metal.

The front panel 26 includes container openings 30 equal in number of the number of tubular receptacles 14. Most of the container openings 30 are T-shaped to facilitate entry of the receptacles 14 therethrough prior to attachment to the front panel 26.

The front panel 26 also includes a plurality of spaced, parallel, weather strip portions 32 formed adjacent the top and bottom of each container opening 30. The front panel 26 also includes a pair of spaced, parallel, weather strip portions 34 which are formed substantially perpendicular to the weather strip portions 32 at the two lateral sides of the front panel 26. Consequently, the two outermost strip portions 32 and the pair of strip portions 34 define the outer periphery of the front panel 26.

A U-shaped channel member 36 is fixedly mounted to the front panel 26, for example, by permanently welding the channel member 36 between the two vertical sets of container openings 30. In this way, each of the receptacles 14 is framed by weather strip portions 32 and 34 and the channel member 36. However, it is to be understood that more than a single U-shaped channel 36 may be provided if more than two vertical sets of container openings 30 are provided.

The tubular receptacles 14 are also preferably formed from one continuous piece of sheet metal. Additional security is provided to the contents of each receptacle 14 in that two sheet metal walls must be penetrated to give access to any individual receptacle from the top, bottom and lateral sides of the apparatus 10.

Each receptacle 14 includes front attachment flanges 38 formed about the outer periphery of its receptacle opening 18. Each receptacle 14 also includes rear attachment flanges 40, which are formed about the outer periphery of its rear receptacle opening 42.

Figure 6:
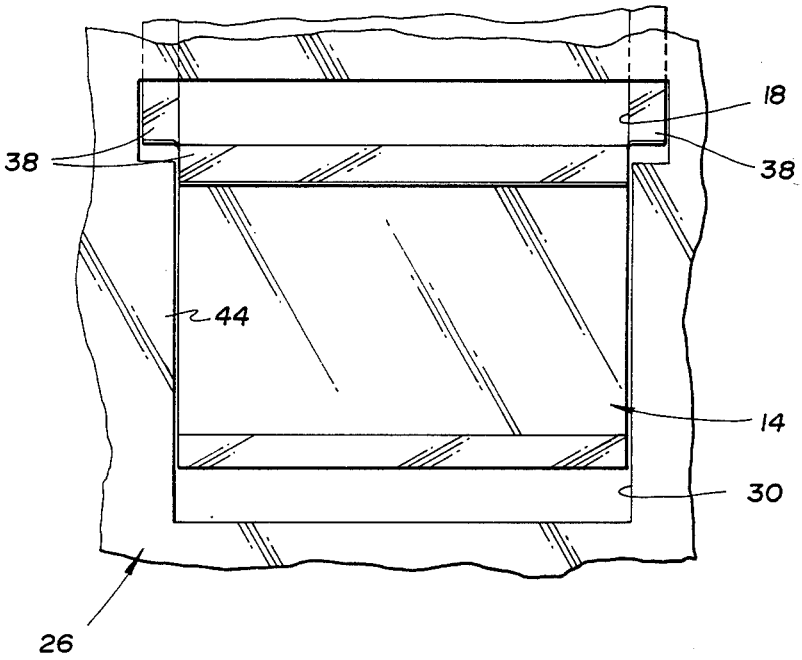
FIG. 6 is a front view, partially broken away, illustrating the method of assembly of a receptacle to a front panel of the present invention.
Figure 7:
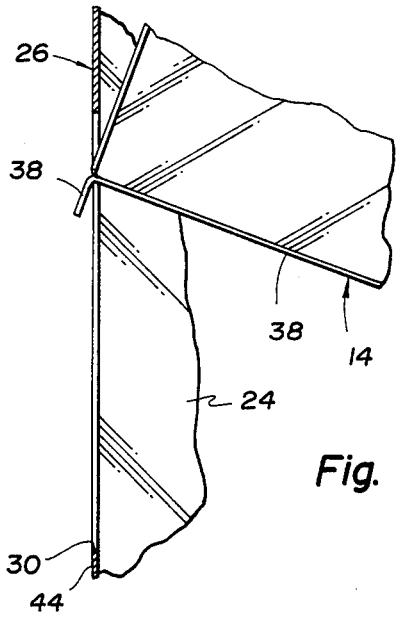
FIG. 7 is a side view, partially broken away and in cross section illustrating the method of assembly of the receptacle to the front panel of the mail box apparatus.

In assembling each of the receptacles 14 to the front panel 26, each receptacle 14 is preferably positioned through its respective container opening 30 so that the front attachment flanges 38 may be fixedly attached to the outer surface 44 of the front panel 26 by rivets, as best shown in FIGS. 6 and 7.

The back panel 28 includes a similar number of access openings 46. The rear attachment flanges 40 of each of the receptacles 14 are secured to the inner surface 48 of the back panel 28 by rivets about the outer periphery of its respective access opening 46. A bent portion 50 of each of the rear attachment flanges 40 extends through a slot 52 formed through the back panel 28 about the outer periphery of its respective access opening 46. The portions 50 further secure the receptacles 14 to the back panel 28.

The rear access openings 46 may be left exposed to permit immediate access thereto, for example, for use in an apartment complex. Alternately, a key-operated rear locking panel (not shown) may be provided to prevent access to the rear access openings 46 when the apparatus 10 is used as a self-standing unit.

Each of the hinge door assemblies 16 is designed to provide a high-strength, watertight unit which is also cosmetically appealing. Each of the assemblies 16 includes a hinge rod 58 which is fixedly mounted such as by welding at its opposite ends to the uppermost and lowermost weather strip portions 32. Each rod 58 also extends through holes 60 (only one of which is shown) formed through the intermediate strip portions 32.

Each of the hinge door assemblies 16 also includes a set of vertically aligned, metal receptacle doors, generally indicated at 62, which are individually spaced and hingedly mounted on the hinge rod 58 at spaced locations corresponding to their respective receptacle openings 18. Each of the receptacle doors 62 includes a hinge portion 63 for attachment to its respective hinge rod 58. Each door 62 also includes a locking mechanism 64 of conventional design. The locking mechanism may be key-operated to lock its respective receptacle door 62 in its closed position thereby restricting access to its respective receptacle 14.

The above-described, multiple-unit mail box apparatus 10 is constructed of a relatively small number of parts which are simple and inexpensive to make and assemble. In particular, the front panel 26 is formed in such a fashion so that its resulting structure performs a multitude of functions. For example, the front panel 26 supports the receptacles 14 at their front end portions. Also, the front panel 26 includes weather strip portions 32 and 34 which, in turn, provide attachment locations for the hinge rods 58 of the assemblies 16.

Despite its simplicity and cost effectiveness, the apparatus 10 provides a high security, high-strength unit which is also cosmetically appealing. The apparatus 10 is also resistant to inclement weather conditions.

While a preferred embodiment of a multiple-unit mail box apparatus has been shown and described herein in detail, those skilled in this art will recognize various alternative designs and embodiments for practicing the present invention as defined by the following claims.

What is claimed is:

1. A multiple-unit mail box apparatus comprising:

an outer support structure having interconnected top, bottom and side panels including front and back panels, said front panel having a plurality of container openings including an aligned set of container openings;

a like plurality of tubular receptacles supported by said support structure therewithin in spaced relationship from each other between said front and back panels adjacent said container openings, each of said receptacles having a receptacle opening formed at its front end thereof to receive mail inserted therethrough, and a hinge door assembly for selectively opening and closing said receptacle openings, said assembly including a hinge rod fixedly mounted at its opposite ends to said front panel and a set of aligned receptacle doors individually and hingedly mounted on said hinge rod at spaced locations corresponding to an aligned set of said receptacle openings; wherein said front panel includes a plurality of spaced, parallel, weather strip portions formed immediately adjacent their respective container openings, said hinge rod being fixedly mounted at its opposite ends to the outermost strip portions and extending through at least one strip portion intermediate the outermost strip portions.

2. The apparatus of claim 1 wherein said receptacles include front attachment flanges attached at the outer surface of the front panel about the outer periphery of the respective container openings.

3. The apparatus of claim 2 wherein said receptacles include rear attachment flanges attached at the inner surface of said back panel.

4. The apparatus of claim 3 wherein said back panel includes a like plurality of access openings and wherein portions of said rear attachment flanges extend through said back panel about the outer periphery of their respective access opening.

5. The apparatus of claim 1 wherein each of said receptacle doors includes a locking mechanism mounted thereon for locking the receptacle door in its closed position.

6. The apparatus of claim 1 including a matrix of at least two aligned rows and two aligned columns of said tubular receptacles and further comprising a second hinge door assembly including a second hinge rod fixedly mounted at its opposite ends to said front panel and parallel to said first hinge rod for rotatably mounting a second set of aligned receptacle doors adjacent their respective receptacle openings.

7. The apparatus of claim 6 including a U-shaped channel member parallel to said hinge rods and mounted on said front panel between the two sets of receptacle doors.

8. The apparatus of claim 1 wherein said front panel includes a second plurality of spaced weather strip portions formed substantially perpendicular to said first plurality of weather strip portions and forming two opposite sides of the outer periphery of the front panel.

9. A multiple-unit mail box apparatus comprising:

an outer support structure having interconnected top, bottom and side panels including front and back panels, said front panel having a plurality of container openings including a pair of aligned sets of said container openings;

a matrix of at least two aligned rows and two aligned columns of tubular receptacles supported by said support structure therewithin in spaced relationship from each other between said front and back panels adjacent said container openings, each of said receptacles having a receptacle opening formed at its front end thereof to receive mail inserted therethrough; and a pair of hinge door assemblies, each of said assemblies including a hinge rod fixedly mounted at its opposite ends to said front panel and a set of aligned receptacle doors individually hingedly mounted on said hinge rod at spaced locations corresponding to their respective aligned sets of receptacle openings, each of said hinge door assemblies selectively opening and closing an aligned set of said receptacle openings; wherein said front panel includes a plurality of spaced parallel weather strip portions formed immediately adjacent said respective container openings, each of said hinge rods being fixedly mounted at its opposite ends to outermost strip portions and extending through at least one strip portion intermediate said pair of outermost strip portions.

10. The apparatus of claim 9 wherein said receptacles include front attachment flanges attached at the outer surface of the front panel about the outer periphery of their respective container openings.

11. The apparatus of claim 10 wherein at least one of said container openings is T-shaped to permit its associated receptacle and front attachment flanges to be inserted therethrough.

* * * * *